US008443465B2

(12) United States Patent
Stewart

(10) Patent No.: US 8,443,465 B2
(45) Date of Patent: May 21, 2013

(54) WEIGHT TRAINING GARMENT SYSTEM

(76) Inventor: Calvin Stewart, Brooklyn, NY (US)

( * ) Notice: Subject to any disclaimer, the term of this patent is extended or adjusted under 35 U.S.C. 154(b) by 367 days.

(21) Appl. No.: 12/754,231

(22) Filed: Apr. 5, 2010

(65) Prior Publication Data

US 2011/0167533 A1 Jul. 14, 2011

Related U.S. Application Data

(60) Provisional application No. 61/167,325, filed on Apr. 7, 2009.

(51) Int. Cl.
*A41D 1/00* (2006.01)

(52) U.S. Cl.
USPC ..... 2/94; 2/69; 2/96; 2/102; 482/93; 482/105

(58) Field of Classification Search
USPC ..... 2/102, 69, 94, 456, 247, 2.5, 108, 2/115, 227, 79, 228, 238, 125, 161.1, 60, 2/243.1, 81, 250; 482/105, 139, 74, 93, 148, 482/120
See application file for complete search history.

(56) References Cited

U.S. PATENT DOCUMENTS

| | | | | |
|---|---|---|---|---|
| 4,602,387 | A * | 7/1986 | Zakrzewski | 2/102 |
| 5,010,596 | A * | 4/1991 | Brown et al. | 2/228 |
| 5,553,322 | A * | 9/1996 | Cebo-Johnson | 2/69 |
| 6,029,270 | A * | 2/2000 | Ost et al. | 2/2.5 |
| 6,209,135 | B1 | 4/2001 | Irvin | |
| 2002/0010058 | A1 * | 1/2002 | Myrick | 482/92 |
| 2003/0092544 | A1 | 5/2003 | Reed | |
| 2006/0046913 | A1 * | 3/2006 | Squittieri | 482/124 |
| 2006/0135326 | A1 * | 6/2006 | Virji et al. | 482/105 |

* cited by examiner

*Primary Examiner* — Khoa Huynh
*Assistant Examiner* — Khaled Annis
(74) *Attorney, Agent, or Firm* — Dickstein Shapiro LLP

(57) ABSTRACT

The training system comprises a shell adapted to conform to a portion of a body of a wearer. The shell includes an exterior surface and an interior body contact surface. The interior body contact surface includes at least one pocket that is positioned and sized so as to correspond to an anatomical muscle group of the wearer. Preferably, the shell includes a plurality of sets of pockets, each set of pockets being shaped and positioned to correspond to different anatomical muscle groups of the wearer. A weight is also provided for each pocket. The weights are shaped substantially similar to their respective pockets and are formed from a combination of a flexible material and a metal.

15 Claims, 4 Drawing Sheets

22

34

WEIGHT TRAINING GARMENT SYSTEM

CROSS REFERENCE TO RELATED APPLICATIONS

The present application claims priority to U.S. provisional application No. 61/167,325, entitled TRAINING SUIT, filed Apr. 7, 2009, the entire contents of which are incorporated herein by reference.

FIELD OF THE INVENTION

The technology herein related generally to weighted training systems and garments.

BACKGROUND OF THE INVENTION

The use of weighted clothing for resistance training is known. The basic concept is that the addition of the weights creates a greater effect of gravity on the person so as to add resistance during ballistic movements, as well as a greater momentum that needs deceleration at the end of the movement to avoid injury. Currently available weighted garments, however, simply just add an overall weight to the person without regard for a particular placement of those weights. This makes these weighted garments uncomfortable for the wearer. In addition, there are serious concerns about the safety of such weighted garments, such as torso, wrist and ankle weights.

BRIEF SUMMARY OF THE INVENTION

Accordingly, there is a need to provide resistance and endurance weighted garments that reduce the risk of injury and provide a comfortable fit that allows for a free-range of movement during training.

In accordance with an embodiment of the invention, the training system comprises a shell adapted to conform to a portion of a body of a wearer. The shell includes an exterior surface and an interior body contact surface. The interior body contact surface includes at least one pocket that is positioned and sized so as to correspond to an anatomical muscle group of the wearer. Preferably, the shell includes a plurality of sets of pockets, each set of pockets being shaped and positioned to correspond to different anatomical muscle groups of the wearer. A weight is also provided for each pocket. The weights are shaped substantially similar to their respective pockets and are formed from a combination of a flexible material and a metal.

In particular configurations, the shell can be in the form of a vest adapted to conform to a torso of the wearer, a forearm band adapted to conform to a forearm of the wearer, or a lower leg band adapted to conform to a lower leg of the wearer. The shell is also preferably formed from an elastic material, such as neoprene.

There has thus been outlined, rather broadly, the features of the invention in order that the detailed description that follows may be better understood, and in order that the present contribution to the art may be better appreciated. There are additional features of the invention that will be described herein. Additional aspects and advantages of the invention will be apparent from the following detailed description of the exemplary embodiments which are illustrated in the accompanying drawings.

BRIEF DESCRIPTION OF THE DRAWINGS

The invention is illustrated and described herein with reference to the various drawings, in which like reference numbers denote like components, and in which.

DETAILED DESCRIPTION OF THE INVENTION

Figure 1A:
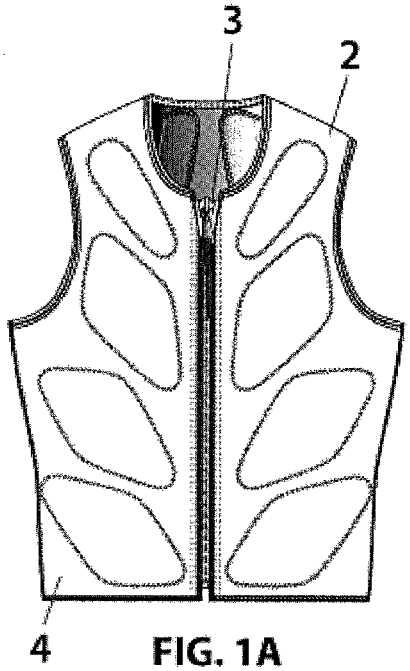
FIGS. 1A-1D illustrate an embodiment of the training system of the invention configured as a vest.
Figure 1C:
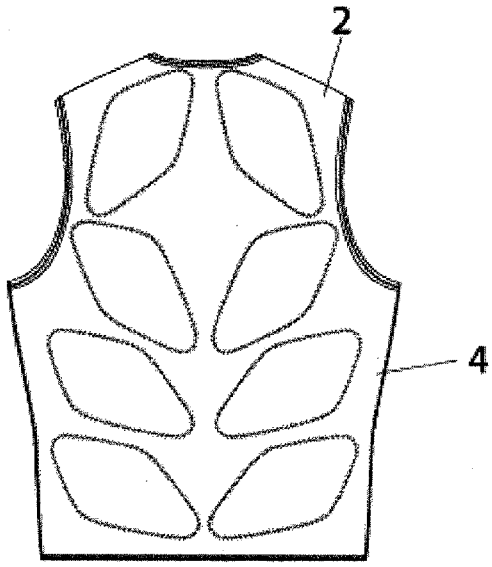
Figure 1B:
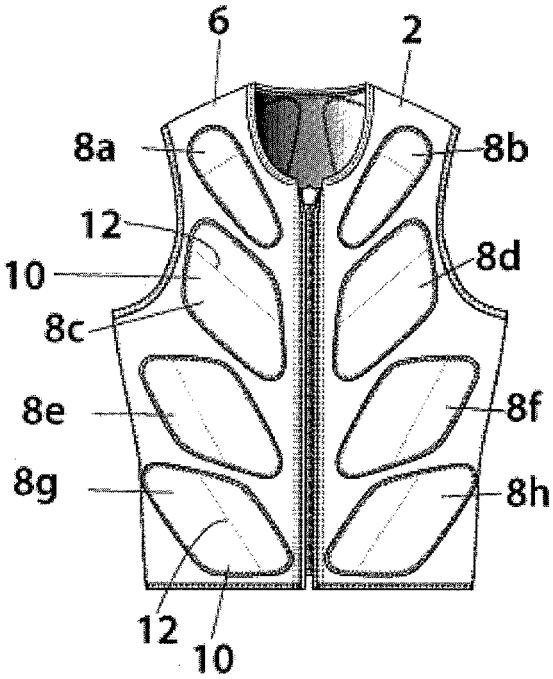
Figure 1D:
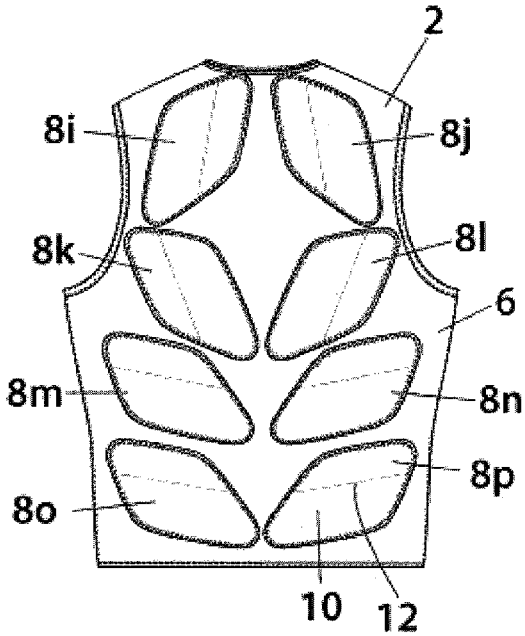
Figure 2A:
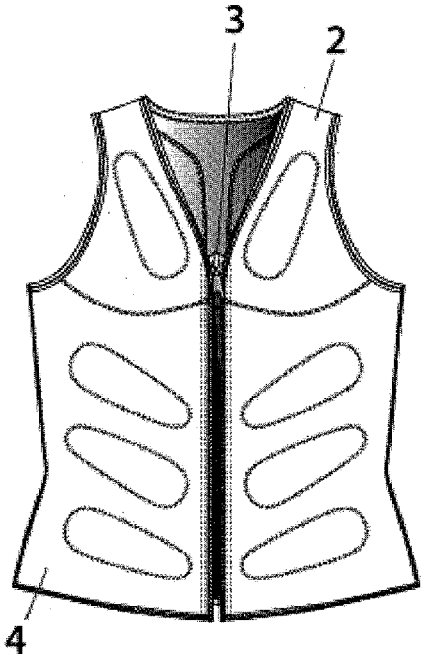
FIGS. 2A-2D illustrate an embodiment of the training system of the invention configured as a vest.
Figure 2C:
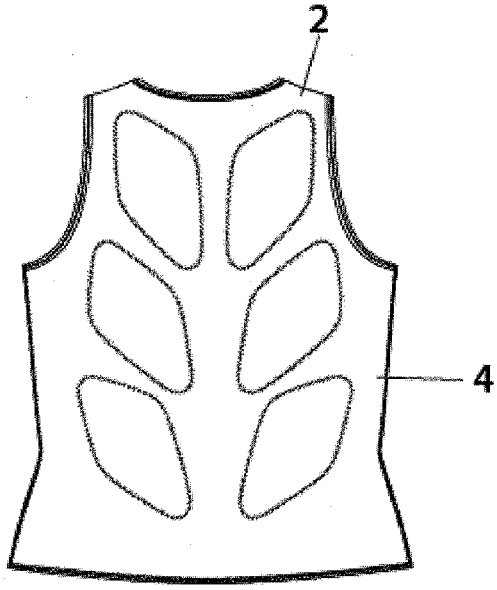
Figure 2B:
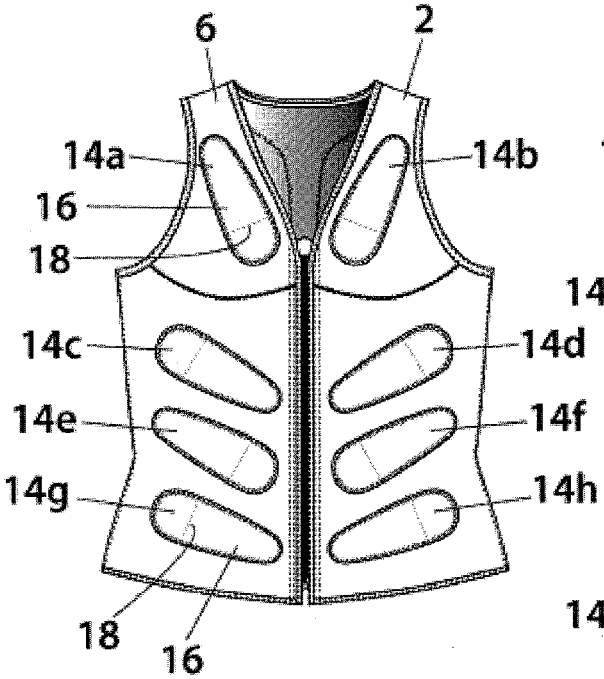
Figure 2D:
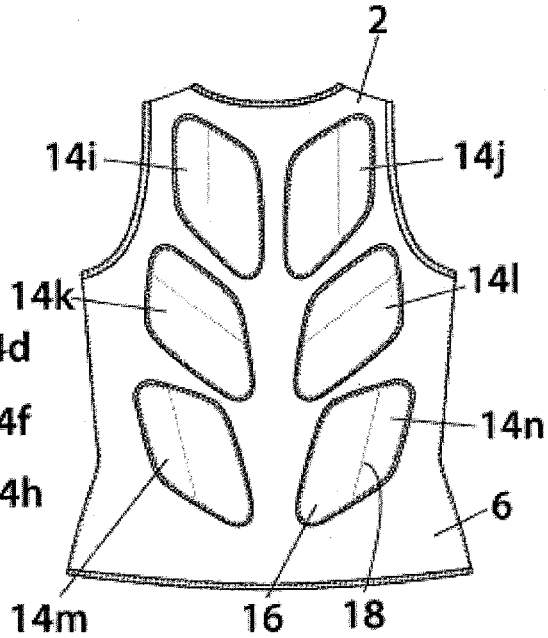

Before describing the embodiments of the invention in detail, it is to be understood that the invention is not limited in its application to the details of the particular arrangement shown here since the invention is capable of other embodiments. Also, the terminology used herein is for the purpose of description and not of limitation.

The training system of the invention can be used in many applications such as sports training, physical fitness, rehabilitation, swimming or aquatics, law enforcement, and military/law enforcement service. The training system comprises a shell adapted to conform to a portion of a body of a wearer. The shell includes an exterior surface and an interior body contact surface. The interior body contact surface includes at least one pocket that is positioned and sized so as to correspond to an anatomical muscle group of the wearer. Preferably, the shell includes a plurality of sets of pockets, each set of pockets being shaped and positioned to correspond to different anatomical muscle groups of the wearer. A weight is also provided for each pocket.

The system also contains multiple removable weights for each pocket. The weights are shaped substantially similar to their respective pockets and are formed from a combination of a flexible material and a metal, which allows the weights to conform to the body of a wearer when the training system is worn. Preferably, the flexible material is a natural or synthetic rubber or a thermoplastic elastomer. As used herein, thermoplastic elastomer is intended to cover any material having rubber-like properties, and in particular a class of copolymers or a physical mix of polymers (such as a plastic and a rubber) which consist of materials with both thermoplastic and elastomeric properties. Preferred thermoplastic elastomers include styrene block copolymers, polyolefin blends, elastomeric alloys, thermoplastic polyurethanes, thermoplastic copolyester and thermoplastic polyamides.

Referring now to the drawings, FIGS. 1A-1D show a first embodiment of the training system of the invention wherein the shell 2 is configured as a vest which covers the front and back of the torso of a wearer, and includes an optional zipper 3 for easy use. In the particular embodiment shown in FIGS. 1A-1D, the vest is configured for a man. The vest includes an exterior surface 4 and an interior body contact surface 6. The interior body contact surface 6 includes a plurality of sets of pockets 8*a*-8*p*.

The system also contains multiple removable weights that are provided for each pocket 8*a*-8*p*. The weights are shaped substantially similar to their respective pockets 8*a*-8*p* and are formed from a combination of a flexible material, such as a natural or synthetic rubber or a thermoplastic elastomer, having a metal suspended therein. This allows the weights to conform to the body of a wearer when the training system is worn. Preferably, the weights are formed from a thermoplastic elastomer having a metal suspended therein. Additionally, the use of a flexible material having a metal suspended therein allows for different mass weights to be created which all have the same area dimension (with a slight increase in thickness). This is accomplished by substituting metals having different densities, for example copper and stainless steel. As will be understood by those skilled in the art, the figures show the weights in place within their respective pockets 8*a*-8*p*. In order to retain the weights in their respective pockets 8*a*-8*p*, the pockets preferably include a covering material 10 having a slit 12 therein through which the weights are inserted.

Each set of pockets and weights are shaped, sized and positioned to correspond to different anatomical muscle groups of the wearer so as to apply direct isometrics thereto. For example, the vest shown in FIGS. 1A-1D apply direct isometrics to at least the following muscle groups: pectoralis major, rectus abdominis, external obliques, trapezius, infraspinatus, teres major, and latissimus dorsi. This shaping, sizing and positioning of the weighted portions as shown creates balance for the wearer and impart less stress on the spine and joints of the body because the weight distribution across the torso is maximized. The flexible weight system also conforms to the body and does not impede body movement or add stress to the joints like traditional iron weight vests.

Referring now to FIGS. 2A-2D, a second embodiment of the training system of the invention is shown wherein the shell 2 is configured as a vest for a woman. Similar to FIGS. 1A-1D, the vest includes an exterior surface 4 and an interior body contact surface 6. The interior body contact surface 6 includes a plurality of sets of pockets 14*a*-14*n*. As is readily apparent, the overall shape and number of pockets in the preferred women's embodiment of FIGS. 2A-2D is different than that of the preferred men's embodiment of FIGS. 1A-1D. This difference in design is generally based on the differing centers of gravity between men and women.

The women's embodiment also contains multiple removable weights for each pocket 14*a*-14*n*. The weights are shaped substantially similar to their respective pockets 14*a*-14*n* and are formed from the combination of flexible material and metal. As will be understood by those skilled in the art, the figures show the weights in place within their respective pockets 14*a*-14*n*. In order to retain the weights in their respective pockets 14*a*-14*n*, the pockets preferably include a covering material 16 having a slit 18 therein through which the weights are inserted.

Each set of pockets and weights for the women's embodiment of FIGS. 2A-2D are shaped, sized and positioned to correspond to different anatomical muscle groups of a woman so as to apply direct isometrics thereto. For example, the vest shown in FIGS. 1A-1D apply direct isometrics to at least the following muscle groups: pectoralis major, rectus abdominis, external obliques, trapezius, infraspinatus, teres major, and latissimus dorsi. This shaping, sizing and positioning of the weighted portions as shown creates balance for the wearer and impart less stress on the spine and joints of the body because the weight distribution across the torso is maximized. The flexible weight system also conforms to the body and does not impede body movement or add stress to the joints.

Figure 3A:
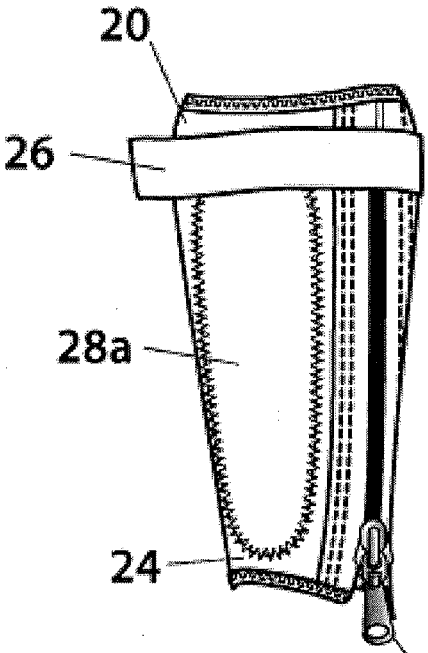
FIGS. 3A-3B illustrate an embodiment of the training system of the invention configured as a forearm band.
Figure 3B:
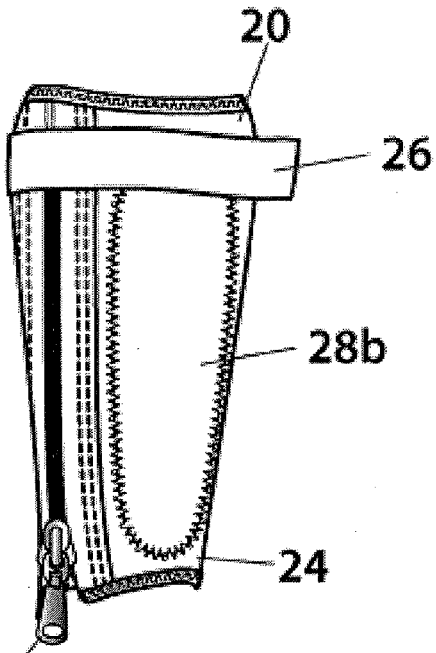

Referring now to FIGS. 3A and 3B, a third embodiment of the training system of the invention is shown configured as left (FIG. 3A) and right (FIG. 3B) forearm bands. As will be understood by those skilled in the art, the forearm bands are constructed similar for both a man and a woman and that, in practical implementation, will differ basically in overall size. The forearm bands are also preferably sized so as to cover the wearer's arm from the elbow to the wrist. As shown, each forearm band includes a shell 20 provided with an optional zipper 22 for ease of use, and an optional securing strap 26 for safely securing the forearm band to the forearm. The shell 20 includes an exterior surface 24 and an interior body contact surface (not shown). The interior body contact surface includes a plurality of pockets 28*a* and 28*b* constructed similar to the pockets of the first and second embodiments so as to retain weights therein. The weights are shaped substantially similar to their respective pockets 28*a* and 28*b* and are formed from the combination of the flexible material and metal. As will be understood by those skilled in the art, the figures show the weights in place within their respective pockets 28*a* and 28*b*.

The pockets 28*a* and 28*b* are positioned to correspond to respective sides of the wearer's forearm so as to allow for an increased range of motion as compared to traditional wrist weights. Each of the pockets and weights for the forearm band embodiment of FIGS. 3A-3B are shaped, sized and positioned to correspond to different anatomical muscle groups of the wearer so as to apply direct isometrics thereto. For example, the forearm bands shown in FIGS. 3A-3B apply direct isometrics to at least the following muscle groups: brachioradialis, finger flexors, and finger extensors.

Figure 4A:
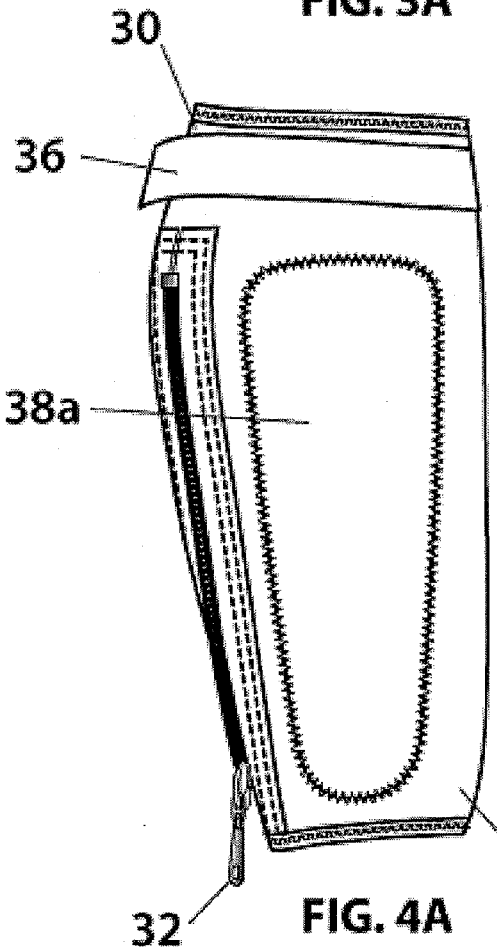
FIGS. 4A-4B illustrate an embodiment of the training system of the invention configured as a lower leg band.
Figure 4B:
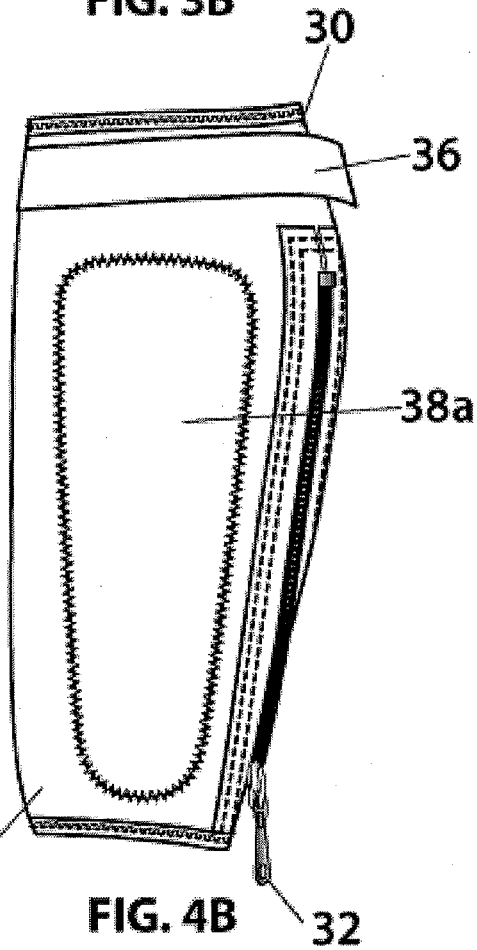

Referring now to FIGS. 4A and 4B, a fourth embodiment of the training system of the invention is shown configured as left (FIG. 4A) and right (FIG. 4B) lower leg bands. As will be understood by those skilled in the art, the lower leg bands are constructed similar for both a man and a woman and that, in practical implementation, will differ basically in overall size. The lower leg bands are also preferably sized so as to cover the wearer's lower leg from below the knee to above the ankle. As shown, each lower leg band includes a shell 30 provided with an optional zipper 32 for ease of use, and an optional securing strap 36 for safely securing the lower leg band to the lower leg. The shell 30 includes an exterior surface 34 and an interior body contact surface (not shown). The interior body contact surface includes a plurality of pockets 38*a* and 38*b* constructed similar to the pockets of the first and second embodiments so as to retain weights therein. The weights are shaped substantially similar to their respective pockets 38*a* and 38*b* and are formed from the combination of the flexible material and metal. As will be understood by those skilled in the art, the figures show the weights in place within their respective pockets 38*a* and 38*b*.

The pockets 38*a* and 38*b* are positioned to correspond to respective sides of the wearer's calf so as to allow for an increased range of motion as compared to traditional ankle weights. Each of the pockets and weights for the leg band embodiment of FIGS. 4A-4B are shaped, sized and positioned to correspond to different anatomical muscle groups of the wearer so as to apply direct isometrics thereto. For example, the lower leg bands shown in FIGS. 4A-4B apply direct isometrics to at least the following muscle groups: tibialis anterior, gastrocnemius and soleus. The lower leg bands operate to place additional weight on both sides of the calf muscles, which in turn creates a drag factor in addition to the extra resistance from the weights themselves.

Figure 5B:
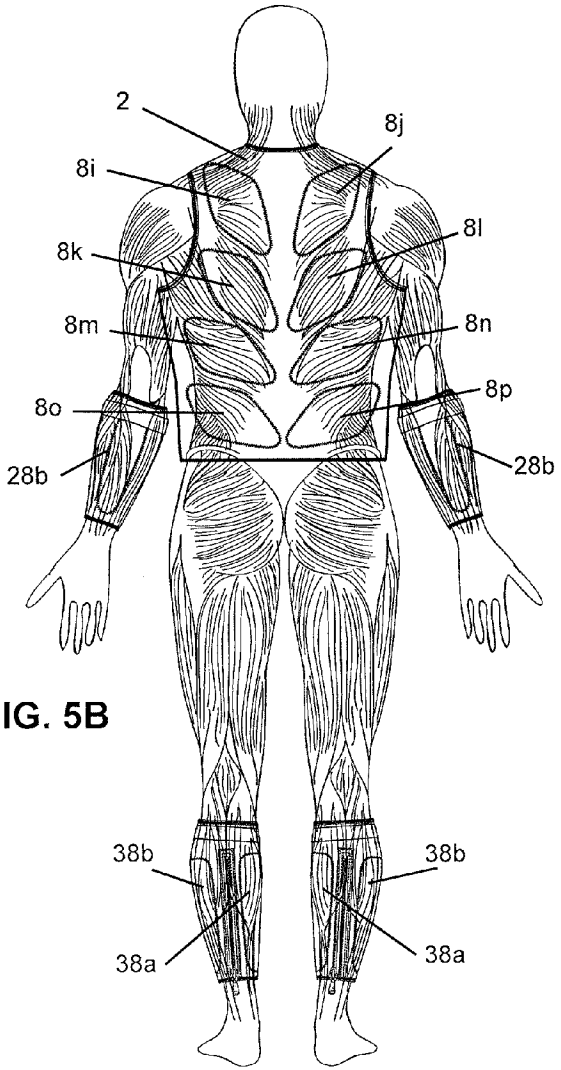
FIGS. 5A and 5B show the embodiment of FIGS. 1A-1D positioned over a musculoskeletal system of a wearer.
Figure 5A:
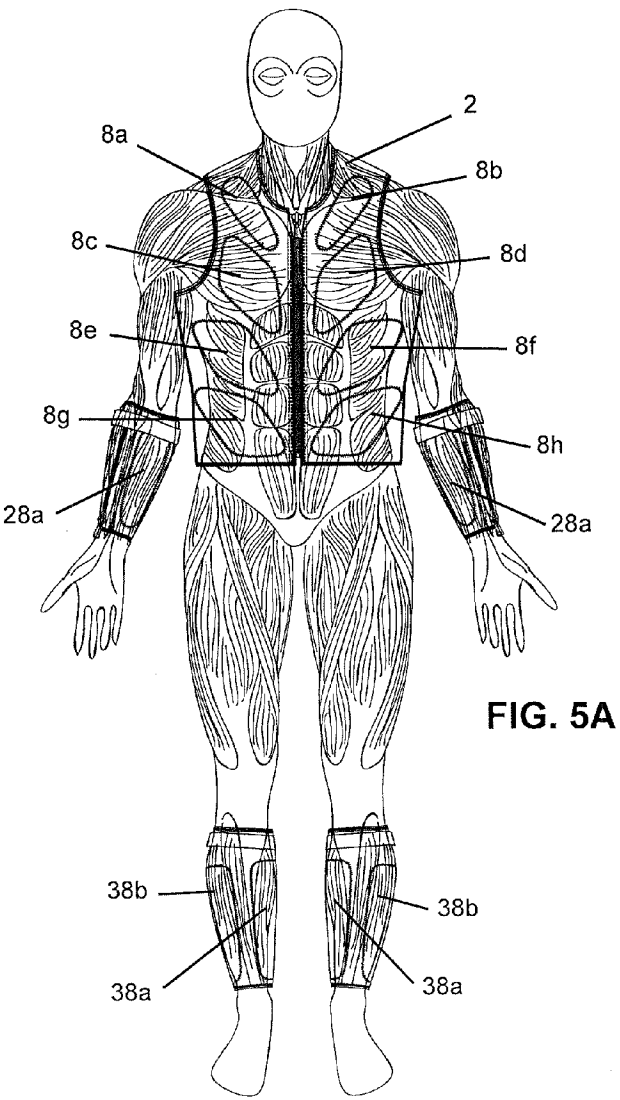

Referring now to FIGS. 5A and 5B, an embodiment of the training system of the present invention using the vest embodiment of FIGS. 1A-1D, the forearm band embodiment of FIGS. 3A-3B and the lower leg band embodiment of FIGS. 4A-4B positioned over a musculoskeletal system of a wearer is shown. As shown in FIG. 5A, the eight weight pockets 8*a*-8*h* on the front portion of the vest 2 are symmetrically arranged relative to the zipper 3 of the vest 2, and each overlap at least two muscle groups of the wearer. The eight weight pockets 8*a*-8*h* located on the front portion of the vest include a first set of pockets 8*a* and 8*b* positioned and sized so as to overlap the trapezius and the pectoralis major muscle groups, a second set of pockets 8*c* and 8*d* positioned and sized so as to overlap the pectoralis major and the rectus abdominis muscle groups, a third set of pockets 8*e* and 8*f* positioned and sized so as to overlap the rectus abdominis and the external oblique muscle groups, and a fourth set of pockets 8*g* and 8*h* positioned and sized so as to overlap the rectus abdominis and the external oblique muscle groups of the wearer. As will be appreciated from the present disclosure, the women's vest shown in FIGS. 2A-2D will cover similar muscle groups, and can also have different shaped pockets on the back portion to account for differences between in a woman's anatomy.

As shown in FIG. 5B, the eight weight pockets 8*i*-8*p* on the back portion of the vest 2 are also symmetrically arranged relative to each other. The eight weight pockets 8*i*-8*p* located on the back portion of the vest include a first set of pockets 8*i* and 8*j* positioned and sized so as to overlap the trapezius muscle group, a second set of pockets 8*k* and 8*l* positioned and sized so as to overlap the trapezius muscle group, a third set of pockets 8*m* and 8*n* positioned and sized so as to overlap latissimus dorsi muscle group, and a fourth set of pockets 8*o* and 8*p* positioned and sized so as to overlap the latissimus dorsi muscle group of the wearer. As will be appreciated from the present disclosure, the women's vest shown in FIGS. 2A-2D will cover similar muscle groups, but with fewer pockets on the back portion.

As will be readily apparent, a wearer can combine a vest with either forearm bands and/or lower leg bands to create a total training system. For example, the combination of both the vest and the forearm bands indirectly works the following muscle groups: biceps brachii, brachialis, and triceps brachii. Likewise, the combination of both the vest and lower leg bands indirectly works the following muscle groups: adductor longus, gracilis, sartorius, rectus femoris, vastus lateralis, vastus medialis, gluteus maximus, semitendinosus, biceps femoris and semimembranosus.

It is preferred that the material of the shell for each of the various embodiments is an elastic breathable fabric that compresses the particular portion of the wearer's body to which it is placed. For example, it is preferred that the various embodiments be constructed from neoprene. The use of such a material imparts a feeling of mid-altitude training to the wearer. Other materials that are contemplated include a flexible micro fiber that allows perspiration to be forced away from the body to create a cool training environment, and a canvas flexible lightweight breathable fabric designed to withstand the elements, to name a few.

The training system of the invention can be used in many applications such as sports training, physical fitness training, rehabilitation, swimming or aquatics, programs of law enforcement and military services. For adaptation for military/law enforcement use, the entire suit (vest, armbands and leg bands) and the weights can be replaced with Kevlar or other bullet/projectile resistant materials to protect a wearer.

The sizing, shaping and positioning of the weighted portions as shown within the various embodiments maximizes weight distribution across the torso, forearms and lower legs of the wearer which creates better balance for the wearer and impart less stress on the joints of the body. The flexible weight system conforms to the body and does not impede body movement like traditional iron weight vests, thereby also decreasing stress to the joints compared to traditional wrist and ankle weights. This in turn, provides a safer system that is more adaptable to an individual's training needs for an increase in athletic performance.

Moreover, because the weights are removable and replaceable with weights having a greater mass but not a greater area (just a slightly greater thickness), many different types and levels of training can be carried out ranging from beginners to professional athletes. Accordingly, the training system of the invention can be used in endurance and resistance training for the purposes of reducing body fat, building muscle, increasing bone density, and increasing speed performance, to name a few.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the technology and are intended to be covered by the following claims.

What is claimed is:

1. A training system comprising:

a vest adapted to conform to a torso of a wearer, the vest having an exterior surface and an interior body contact surface, the vest having a front portion covering a front of the wearer and a back portion covering a back of the wearer, and the vest being made of a material that compresses the torso of the wearer;

eight weight pockets located on the front portion of the vest;

at least six weight pockets located on the back portion of the vest; and a plurality of weights, each respective weight of the plurality of weights being shaped substantially similar to a respective weight pocket of each of the eight weight pockets and the at least six weight pockets, the plurality of weights being a flexible material that conforms to the torso of the wearer corresponding to the location of each respective weight pocket wherein the eight weight pockets located on the front portion of the vest consist of:

a first set of left and right pockets, each is designed to be positioned and sized so as to overlap trapezius and pectoralis major muscle groups of the wearer;

a second set of left and right pockets, each is designed to be positioned and sized so as to overlap the pectoralis major and rectus abdominis muscle groups of the wearer;

a third set of left and right pockets, each is designed to be positioned and sized so as to overlap the rectus abdominis and external oblique muscle groups of the wearer; and a fourth set of left and right pockets, each is designed to be positioned and sized so as to overlap the rectus abdominis and the external oblique muscle groups of the wearer.

2. The training system according to claim 1, wherein the flexible material is selected from the group consisting of natural rubbers, synthetic rubbers and thermoplastic elastomers.

3. The training system according to claim 1, wherein the flexible material is selected form the group consisting of styrene block copolymers, polyolefin blends, elastomeric alloys, thermoplastic polyurethanes, thermoplastic copolyester and thermoplastic polyamides.

4. The training system according to claim 1, wherein the front portion of the vest is divided into a first half and a second half, the first half and second half being joined by a zipper.

5. The training system according to claim 4, wherein each of the first through fourth sets of pockets each include first and second weight pockets, and wherein the first weight pockets in each of the first through fourth sets of pockets are positioned on the first half of the vest, and the second weight pockets in each of the first through fourth sets of pockets are positioned on the second half of the vest.

6. The training system according to claim 5, wherein the first and second weight pockets are symmetrically arranged relative to the zipper.

7. The training system according to claim 5, wherein the at least six weight pockets located on the back portion of the vest are arranged into at least three matched sets comprising first and second weight pockets in each of the at least three matched sets, and wherein the first weight pockets and second weight pockets in each of the at least three matched sets are arranged symmetrically on the back portion of the vest relative to each other.

8. The training system according to claim 1, further comprising a forearm band adapted to conform to a forearm of the wearer, the forearm band having an exterior surface and an interior body contact surface, at least one forearm weight pocket, and at least one weight shaped substantially similar to the at least one forearm weight pocket.

9. The training system according to claim 1, further comprising a lower leg band adapted to conform to a lower leg of the wearer, the lower leg band having an exterior surface and an interior body contact surface, at least one lower leg weight pocket, and at least one weight shaped substantially similar to the at least one lower leg weight pocket.

10. The training system according to claim 1, wherein the at least eight weight pockets are positioned on the interior body contact surface of the vest.

11. The training system according to claim 10, wherein the at least eight weight pockets include a covering configured to allow removal and replacement of the respective weight therein.

12. The training system according to claim 1, wherein the at least eight weight pockets include a covering configured to allow removal and replacement of the respective weight therein.

13. The training system according to claim 1, wherein each of the first through fourth sets of pockets each include first and second weight pockets, and wherein the first weight pockets in each of the first through fourth sets of pockets are positioned on the first half of the vest, and the second weight pockets in each of the first through fourth sets of pockets are positioned on the second half of the vest.

14. The training system according to claim 13, wherein the at least six weight pockets located on the back portion of the vest are arranged into at least three matched sets comprising first and second weight pockets in each of the at least three matched sets, and wherein the first weight pockets and second weight pockets in each of the at least three matched sets are arranged symmetrically on the back portion of the vest relative to each other.

15. The training system according to claim 1, wherein the at least six weight pockets located on the back portion of the vest are arranged into at least three matched sets comprising first and second weight pockets in each of the at least three matched sets, and wherein the first weight pockets and second weight pockets in each of the at least three matched sets are arranged symmetrically on the back portion of the vest relative to each other.

* * * * *